United States Patent [19]

Bieber

[11] Patent Number: 4,854,490

[45] Date of Patent: Aug. 8, 1989

[54] AMMUNITION CARRIER

[76] Inventor: William J. Bieber, 21901 Adler Dr., California City, Calif. 93505

[21] Appl. No.: 167,521

[22] Filed: Mar. 14, 1988

[51] Int. Cl.[4] ..... A45F 3/02

[52] U.S. Cl. ..... 224/202; 224/196; 42/87

[58] Field of Search ..... 224/202, 203, 196; 42/87, 88; 221/296, 298

[56] References Cited

U.S. PATENT DOCUMENTS

| | | | |
|---|---|---|---|
| 45,469 | 12/1864 | Blakeslee . | |
| 54,147 | 4/1866 | Hammond . | |
| 568,220 | 9/1896 | Walker . | |
| 910,397 | 1/1909 | Laudensack | 42/87 |
| 1,645,638 | 10/1927 | Abraham | 42/87 |
| 2,528,648 | 11/1950 | Garver | 224/196 |
| 3,272,411 | 9/1966 | Hanson . | |
| 3,281,013 | 10/1966 | Motard . | |
| 3,845,889 | 11/1974 | Hurd . | |
| 4,381,845 | 5/1983 | Feis . | |
| 4,685,600 | 8/1987 | Reuschel | 224/196 |

FOREIGN PATENT DOCUMENTS

| | | | |
|---|---|---|---|
| 2970 | of 1890 | United Kingdom | 224/203 |
| 7797 | of 1914 | United Kingdom | 42/87 |

*Primary Examiner*—Renee S. Luebke
*Assistant Examiner*—Linda J. Sholl
*Attorney, Agent, or Firm*—Howson and Howson

[57] ABSTRACT

An ammunition carrier particuarly suited for storing cartridges and dispensing a selected quantity of the same into a tubular magazine, such as associated with .22-caliber rifles. The carrier includes an elongated flexible tube, such as transparent plastic, with a funnel at one end and a plug at the opposite end. Spring wire escapements are provided at spaced axial locations on the tube, each having a radial inwardly extending arm adapted to engage a cartridge for preventing cartridges from sliding out of the funnel until appropriately positioned. The escapements are separated axially an amount corresponding to the number of cartridges to be loaded in the rifle magazine. A hook and eyelet are provided to enable the tube to be formed into a loop and carried over a person's shoulder.

8 Claims, 2 Drawing Sheets

FIG. 1
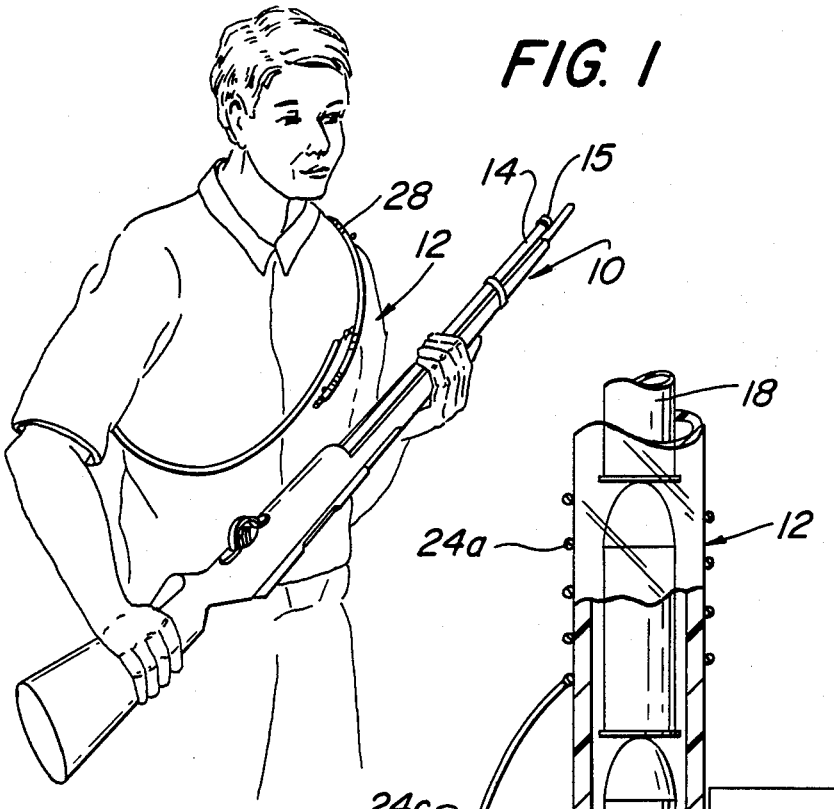
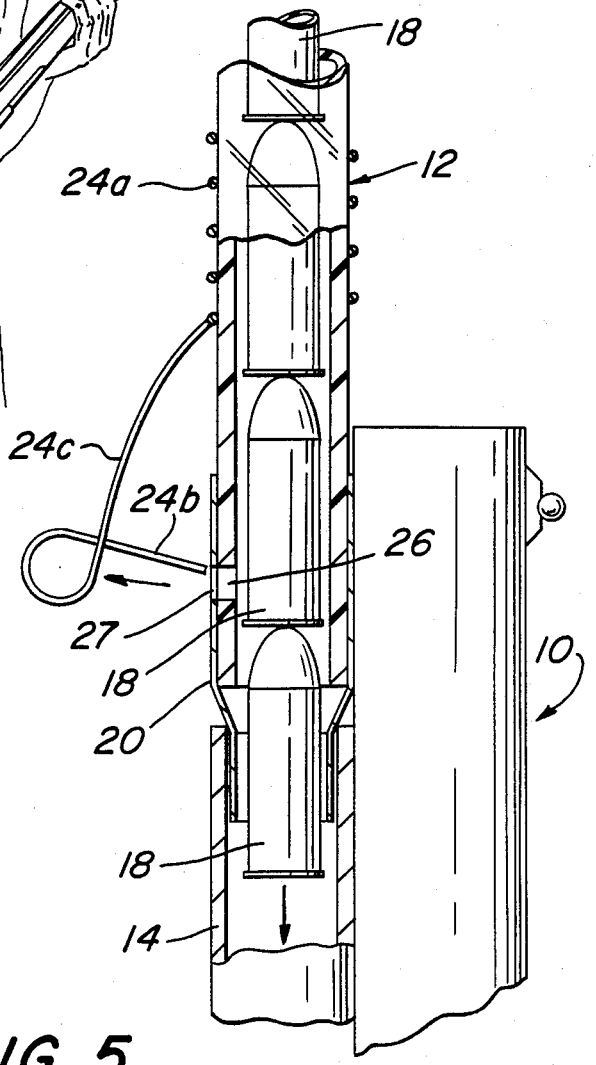
FIG. 5

AMMUNITION CARRIER

BACKGROUND OF THE INVENTION

The present invention relates to improvements in ammunition carriers, and more particularly, to an improved cartridge storage and dispensing carrier for loading rifles having tubular magazines.

Magazines for feeding ammunition into the breech of a rifle are generally of the clip or tubular type and store a limited number of rounds or cartridges. The clip type is removable from the rifle, so that a number of clips can be preloaded and carried separately for quick replacement of a spent clip. However, the tubular magazine is usually fixed to the rifle's barrel and the number of cartridges which may be pre-loaded is limited to the capacity of a single magazine. Consequently, the rifleman carries the extra cartridges in a separate box or loosely in his pocket and reloads the magazine each time it empties. The cartridges must be fed by hand, one at a time, into the magazine. Valuable hunting time or shooting opportunities may be lost. If the reloading is done outdoors in the field, there is the added risk of dropping the cartridges on the ground or in snow. In that event, the cartridges must be wiped off, and in doing so, lubricant coating by the manufacturer is also removed and its absence may cause leading in the barrel.

SUMMARY OF THE INVENTION

Accordingly, it is an object of the present invention to provide a novel ammunition carrier for use with rifles having tubular magazines. Another object is to provide a carrier which can be pre-filled with a quantity of cartridges sufficient for several complete loadings of the tubular magazine; and which will measure and dispense the number of cartridges required for a complete loading of the magazine, or any desired lesser amount. Another object is to provide an ammunition carrier which can be filled in a clean environment prior to field use, and at times more convenient than during hunting or a shooting competition. Still another object is to provide a carrier which can be formed into an adjustable closed loop and slung over the shoulder. A further object is to provide an ammunition carrier which is simple to manufacture, operate and maintain; which uses conventional and inexpensive materials and components; and which is relatively safe for use while hunting or shooting.

Briefly, these and other objects are accomplished by a bandoleer-type ammunition carrier which stores and dispenses a measured quantity of cartridges into a tubular magazine of the type associated with certain 0.22-caliber rifles. The carrier includes a flexible tube, such as of clear plastic, with a funnel at one end and a plug at the other, which slidably receives a quantity of cartridges. Spring wire escapements are provided at selected locations along the tube, each having an arm extending into the tube for preventing cartridges from sliding through the tube or out of the funnel until manually withdrawn. These escapements are separated axially an amount corresponding to the linear space taken up by the number of cartridges to be loaded into the rifle magazine at any one time. A hook and eye arrangement enables the tube to be formed into a loop and carried over either shoulder.

These and other objects, advantages and novel features of the invention will become apparent from the following detailed description of the invention when considered in conjunction with the accompanying drawings wherein:

BRIEF DESCRIPTION OF THE DRAWINGS

FIG. 1. illustrates an ammunition carrier according to the invention and a rifle of the type having a tubular magazine;

FIG. 5 is a fragmentary view of the carrier with cartridges being loaded into the tubular magazine of the rifle.

DESCRIPTION OF THE PREFERRED EMBODIMENT

Figures 2, 3, 4:
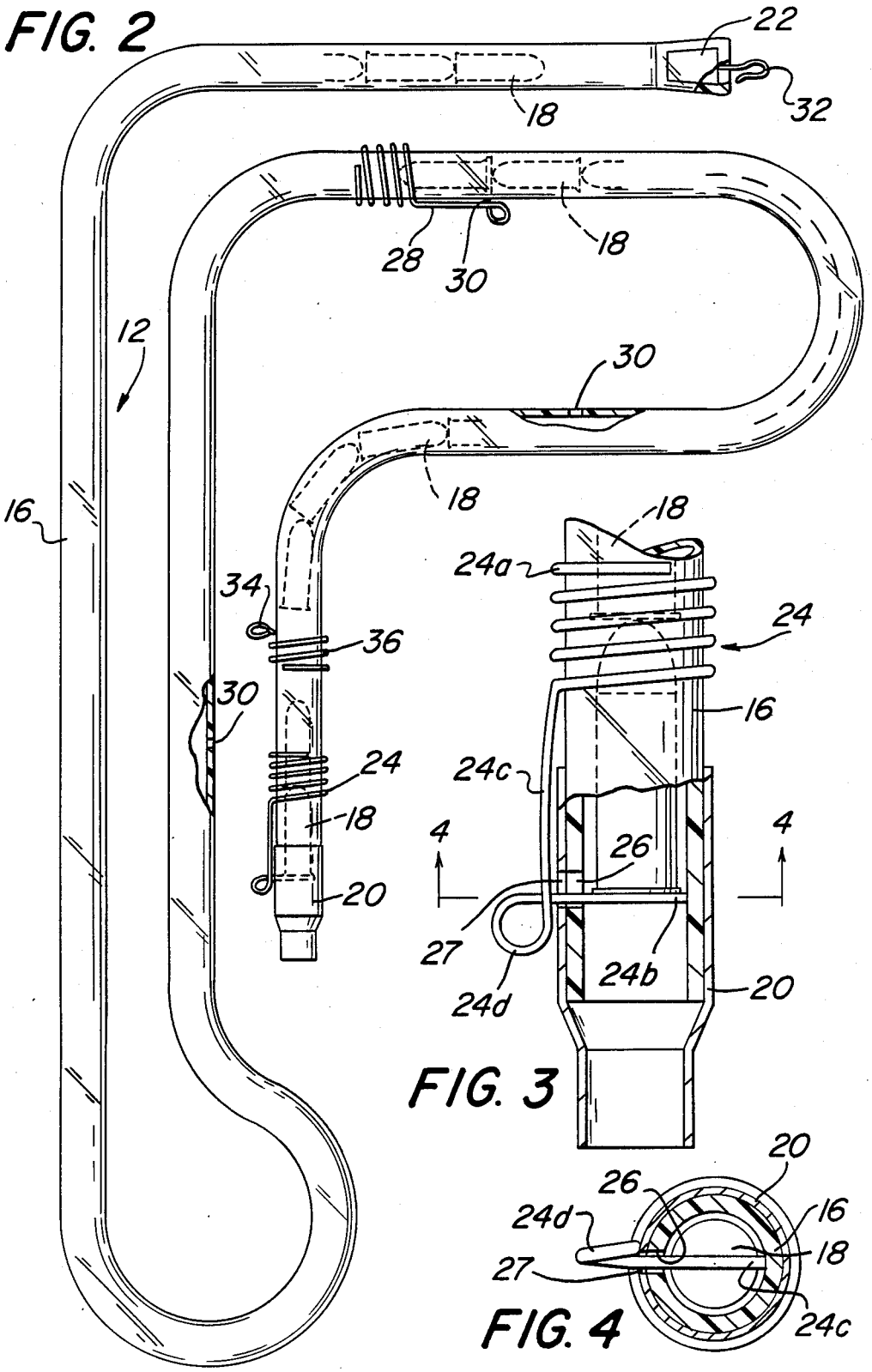
FIG. 2 is a view, of the carrier of FIG. 1 partly.cut away and laid out in a folded position.
FIG. 3 is an enlarged view of one end of the carrier partly cut away at an escapement mechanism.
FIG. 4 is a cross-sectional view of carrier at the escapement mechanism, taken along line 4—4 of FIG. 3.

Referring now to the drawings wherein like characters designate like or corresponding parts throughout the several views, there is shown on FIG. 1 a 0.22-caliber rifle 10 held by a rifleman wearing an ammunition carrier 12 according to the invention. Rifle 10 includes a conventional tubular magazine 14 fixed along its length to the barrel and communicates at the breech for loading the firing chamber a single cartridge at a time. The cartridges are usually urged toward the breech end of the magazine 14 by a compression spring in a long sleeve, not shown, which is inserted after loading and then secured by a twist lock 15 adjacent the muzzle end of rifle 10.

Referring to FIG. 2, ammunition carrier 12 includes a flexible cylindrical tube 16, preferably of transparent plastic, for slidably receiving, end-to-end, a quantity of cartridges 18 along the length thereof. The inside diameter of tube 16 must be large enough to allow cartridges 18 to slide freely downward but without skewing when tube 16 is vertically extended. Tube 16 terminates at one end with a rigid funnel 20, preferably of metal or hard plastic, which is slightly tapered to slide into the rifle's magazine 14 when its cartridge compression spring and sleeve (not shown) have been withdrawn. The other end of tube 16 is closed by a removable plug 22.

Cartridges 18 are prevented from sliding out through funnel 20 by a manually-operated escapement 24. As better illustrated in FIGS. 3 and 4, escapement 24 is formed of spring wire including a coil **24*a* wound about tube 16 and arm 24*b* extending transversely through aligned holes 26 and 27 in one side of funnel 20 and tube 16 respectively and across the inside of tube 16. Escapement 24 also includes a spring wire cantilever 24*c* connected between coil 24*a* and arm 24*b* along the length of tube 16 which urges arm 24*b* into tube 16. A loop 24*d* formed at the outer end of arm 24*b* provides a convenient grip for withdrawing arm 24*b* from tube 16**.

Referring again to FIG. 2, ammunition carrier 12 further includes another spring-wire escapement 28 substantially identical to escapement 24, except that its coil end must be manually slidable with slight force along the length of tube 16. Its transverse arm is thereby able to register with a selected one of a plurality of holes 30 in the side of tube 16 which are separated axially an amount corresponding to the linear space taken up by the number of cartridges capable of being loaded in the rifle magazine 14 at one time, or any lesser desired number. Carrier 12 can be formed into a loop for carrying over one shoulder and under the opposite arm of a person by a hook 32, preferably secured to plug 22 by engaging an eyelet 34 which extends from one end of a wire coil 36 around tube 16. The size of the loop can be adjusted by sliding coil 36 along the outside of the tube 16 according to the wearer's preference.

Operation of ammunition carrier 12 usually begins with loading at a convenient time and place prior to hunting or shooting competitions. Plug 22 is removed and tube 16 vertically extended with funnel 20 down. Escapement arm **24*b* is inserted in tube 16, and the arm of escapement 28 is fully withdrawn from tube 16 and placed to one side of tube 16. Cartridges 18 are then dropped in, primer end first, one at a time, until tube 16 is filled to capacity, or to a desired lesser quantity. This invention is preferably for use with rim-fired cartridges during loading or at any other time of normal use. Center-fired cartridges may be used only where its construction or materials will not cause detonation if struck by adjacent cartridge in normal usage. It is also preferred that the carrier 12 have a length sufficient to hold the contents of one box of ammunition, usually 50 cartridges. For example, 50 22-caliber cartridges would require a tube 16** about 50 inches long.

When loaded with the desired quantity of cartridges, plug 22 is replaced, and the arm of escapement 28 allowed to return into a hole 30 at a location which allows a fraction of the total quantity of stored cartridges to be dispensed, such as for the full capacity of tubular magazine 14.

Carrier 12 may now be slung over a shoulder and formed into a loop by connecting hook 32 and eyelet 34. The loop size may be adjusted by sliding eyelet 34 along tube 16.

When loading of the rifle magazine is to be accomplished, twist lock 15 is released allowing the compression spring and sleeve in magazine 14 to be withdrawn. Funnel 20 is then firmly seated in the magazine 14, and escapement arm **24*b* manually withdrawn. This allows all cartridges below escapement 28 to slide freely into magazine 14. The compression spring and sleeve 15 are then reinstalled thereby urging the cartridges 18** toward the breech end of the rifle ready for arming.

Another measured quantity of cartridges 18 can now be transferred along tube 16 for the next loading of magazine 14. This is accomplished by reinserting escapement arm **24*b* through hole 27 and removing the arm of escapement 28 from hole 30 to allow cartridges 18 to slide down to escapement 24. It may be necessary to disconnect hook 32 and eyelet 34 and extend tube 16 vertically in order that the cartridges can slide freely. The arm of escapement 28 is then reinserted between adjacent cartridges 18 at the appropriate hole 30**. This procedure may be repeated as often as there are cartridges remaining.

Some of the many advantages of the invention should now be readily apparent. For example, the carrier can be loaded at a more convenient time such as before a hunting trip, at home with clean hands. There is less likelihood of cartridges being stored in dirty pockets or in boxes where they may rattle, and of dropping a cartridge on the ground and rendering it useless because dirt is likely to adhere to the lubricant coating placed on it by the manufacturer. Wiping the dirt off would also remove the lubricant and eventually damage the rifle. The carrier enables loading the rifle magazine easier and much faster, especially in the field where valuable hunting time and shooting opportunities are most desirable. The carrier may also be used to simply dole out a limited quantity of cartridges, center or rim fired, into the users hand for loading revolver cylinders or pistol and rifle clips. The carrier can also be easily manufactured with conventional components and light materials at relatively low cost, and can be easily cleaned and maintained.

Obviously, many modifications and variations of the present invention are possible in light of the above teachings. It is therefore to be understood that within the scope of the appended claims the invention may be practiced otherwise than as specifically described.

What is claimed is:

1. An ammunition carrier for storing and dispensing cartridges associated with a rifle having a tubular magazine, comprising in combination:

a flexible tube formable into a loop for wearing over the shoulder and under an arm of a person and having a passage formed to slidably receive along the length thereof a quantity of the cartridges end to end, said tube being insertable at one end thereof in the muzzle end of the magazine for discharging the cartridges, said tube further including holes spaced from each other along said tube a distance corresponding to the space occupied by a selected maximum number of said cartridges to be dispensed at any one time;

a plurality of escapement means carried by said tube adjacent to selected ones of said holes, said escapement means including means removably projecting into said passage for selectively blocking and unblocking said passage thereat; and connecting means connected to said tube for enabling the tube to be formed into said loop for carrying about the person and to be straightened for loading and unloading cartridges.

2. A carrier according to claim 1 wherein:

each of said escapement means includes a spring-loaded arm removably urged into a selected one of said holes for blocking said passage and a finger grip external of said tube and engageable by said person external of said tube for controlling the discharge from said one end.

3. A carrier according to claim 1 wherein:

said connecting means includes a hook secured to said other end of said tube, and an eyelet slidable along the length of said tube for removably receiving said hook to form said loop.

4. A carrier according to claim 1 wherein: said tube is constructed of a transparent plastic.

5. An ammunition carrier for storing and dispensing cartridges, comprising, in combination:

a flexible tube formable into a loop for wearing over the shoulder of a person and having a passage along the entire length suitable for slidably receiving at one end and for storing a quantity of cartridges end to end without skewing, and apertures spaced along the length thereof forming a plurality of segments each corresponding to the linear spaced occupied by a selected maximum number of said cartridges to be parcelled at any one time to the magazine;

a rigid funnel secured to the other end of said tube for guiding the cartridges out of said tube, and suitably formed for sliding into the muzzle end of a rifle's tubular magazine;

a first escapement permanently connected to said tube and projecting through the aperture nearest to said other end for selectively blocking and unblocking the passage thereat; said first escapement including a finer grip external of said tube engageable by the person's finger thereat to control the discharge of cartridges from said one end, and a second escapement like in construction to said first escapement and similarly connected to said tube and projecting through a selected other of said apertures for selectively blocking and unblocking the passage thereat.

6. A carrier according to claim 5 further comprising:

an eyelet slidable along the length of said tube; and a hook operatively connected to the other end of said tube for removably engaging said eyelet to form an adjustable loop.

7. A carrier according to claim 6 wherein:

said tube is constructed of a transparent plastic.

8. An ammunition carrier for storing and dispensing cartridges, comprising, in combination:

a flexible tube means formable into a loop of sufficient length for wearing over the shoulder and under the opposite arm of a person, and having a passage formed to slidably receive along the length thereof a quantity of the cartridges end to end; and first escapement means carried at one end of said tube means for selectively blocking and unblocking said passage for controlling the release of a number of the cartridges from said one end, said first escapement means having a portion normally disposed inside said tube to effect said blocking action and a finger grip external of said tube operable by a person's fingers thereat to effect said unblocking action;

second escapement means connected to said tube means intermediate the length thereof for releasably blocking said passage thereat, said number being equal to or less than the cartridge holding capacity between said first and second escapement means; and connecting means operatively connected to said tube means for permitting said loop to be formed according to the person's preference for carrying and straightened for loading and unloading cartridges, including a hook secured to said other end of said tube means, and an eyelet slidable along the length of said tube means for removably receiving said hook to form said loop.

* * * * *